US010578123B2

(12) United States Patent
Yacobucci et al.

(10) Patent No.: US 10,578,123 B2
(45) Date of Patent: Mar. 3, 2020

(54) COMPOSITE SUCTION LINERS AND APPLICATIONS THEREOF

(71) Applicant: Kennametal Inc., Latrobe, PA (US)

(72) Inventors: Nathaniel James Yacobucci, Latrobe, PA (US); Travis E. Puzz, Fayetteville, AR (US); Daniel J. De Wet, Inverary (CA); Jonathan Bitler, Fayetteville, AR (US)

(73) Assignee: KENNAMETAL INC., Latrobe, PA (US)

( * ) Notice: Subject to any disclaimer, the term of this patent is extended or adjusted under 35 U.S.C. 154(b) by 417 days.

(21) Appl. No.: 15/412,878

(22) Filed: Jan. 23, 2017

(65) Prior Publication Data

US 2018/0209441 A1 Jul. 26, 2018

(51) Int. Cl.

| | |
|---|---|
| ***F04D 29/42*** | (2006.01) |
| ***F04D 29/22*** | (2006.01) |
| ***C22C 38/00*** | (2006.01) |
| ***C22C 9/05*** | (2006.01) |
| ***C22C 9/04*** | (2006.01) |
| ***C22C 19/05*** | (2006.01) |
| ***C22C 9/06*** | (2006.01) |
| ***C22C 19/07*** | (2006.01) |
| ***C22C 38/04*** | (2006.01) |
| ***C22C 38/12*** | (2006.01) |
| ***C22C 38/18*** | (2006.01) |
| ***C22C 38/38*** | (2006.01) |
| ***F04D 7/04*** | (2006.01) |
| ***F04D 29/02*** | (2006.01) |
| ***F04D 29/24*** | (2006.01) |

(52) U.S. Cl.

CPC ..... *F04D 29/4286* (2013.01); *C22C 9/04* (2013.01); *C22C 9/05* (2013.01); *C22C 9/06* (2013.01); *C22C 19/05* (2013.01); *C22C 19/058* (2013.01); *C22C 19/07* (2013.01); *C22C 38/00* (2013.01); *C22C 38/04* (2013.01); *C22C 38/12* (2013.01); *C22C 38/18* (2013.01); *C22C 38/38* (2013.01); *F04D 7/04* (2013.01); *F04D 29/026* (2013.01); *F04D 29/2205* (2013.01); *F04D 29/2238* (2013.01); *F04D 29/24* (2013.01)

(58) Field of Classification Search

CPC ..... F04D 29/4286; F04D 29/026; F04D 7/04; C22C 29/08

See application file for complete search history.

(56) References Cited

U.S. PATENT DOCUMENTS 5,328,763 A * 7/1994 Terry ..... C22C 29/08 428/559

6,984,454 B2 * 1/2006 Majagi ..... B22F 3/26 428/212

(Continued)

*Primary Examiner* — Kenneth J Hansen
*Assistant Examiner* — Jackson N Gillenwaters
(74) *Attorney, Agent, or Firm* — Larry R. Meenan

(57) ABSTRACT

Composite suction liners and associated centrifugal pump architectures are described herein which, in some embodiments, provide enhanced operating lifetimes under abrasive slurry conditions. For example, a composite suction liner includes a suction liner substrate and a monolithic cladding metallurgically bonded to a face of the suction liner substrate, the monolithic cladding comprising metal matrix composite including a hard particle phase dispersed in matrix metal or alloy.

17 Claims, 4 Drawing Sheets

(56) References Cited

U.S. PATENT DOCUMENTS

| | | | | |
|---|---|---|---|---|
| 8,445,117 | B2 * | 5/2013 | Ding | B23K 1/19 428/680 |
| 8,800,848 | B2 * | 8/2014 | Mirchandani | C23C 24/10 164/80 |
| 9,580,777 | B1 * | 2/2017 | Radon | C22C 37/10 |
| 2014/0057124 | A1 * | 2/2014 | Komolwit | C23C 24/103 428/553 |
| 2014/0140836 | A1 * | 5/2014 | Embrey | F04D 29/026 415/204 |
| 2014/0271318 | A1 * | 9/2014 | Zheng | B22F 7/008 419/7 |
| 2014/0272446 | A1 * | 9/2014 | Zheng | B32B 15/043 428/545 |
| 2014/0369846 | A1 * | 12/2014 | Berglund | F01D 5/286 416/224 |
| 2018/0265987 | A1 * | 9/2018 | D'Introno | F04D 29/4286 |

* cited by examiner

COMPOSITE SUCTION LINERS AND APPLICATIONS THEREOF

FIELD

The present invention relates to suction liners of centrifugal pumps and, in particular, to composite suction liners for centrifugal pumps employed in high wear slurry applications.

BACKGROUND

Centrifugal pumps are generally constructed of an impeller housed in a casing. The impeller includes a number of vanes for imparting centrifugal force to liquid during impeller rotation, moving the liquid radially outward to the discharge side of the pump. Displacement of the liquid by the impeller vanes creates negative pressure at the impeller eye assisting in suction of additional liquid into the pump. A suction liner can be positioned between the inlet side of the casing and the impeller.

Slurry centrifugal pumps present several challenges related to the abrasive characteristics of the slurry. Highly abrasive conditions encountered in the mining of oil sands, for example, place extreme wear stress on pump components, especially the impeller and suction liner. Impeller vanes and suction liner surfaces can quickly erode inducing premature retirement of these components. Such retirement is often out of cycle with the maintenance of other apparatus, leading to increases in downtime of the mining operation. In view of these problems, impeller design is under continuous development to enhance wear characteristics. Impellers, for example, have become larger to permit lower velocities at the vane leading edge, thereby reducing impact forces of slurry particles. Larger impeller size also enables longer vanes for increased operating lifetime. Additionally, suction liners have received design updates to combat wear. Segmented wear plates have been applied to suction liner surfaces. Moreover, weld overlay claddings have been imparted to suction liners. While generally increasing suction liner lifetime, these surface modifications present tribological disadvantages. Seams and joints associated with segmented plates and weld overlay can be sites of enhanced wear and untimely failure.

SUMMARY

In view of these disadvantages, composite suction liners and associated centrifugal pump architectures are described herein which, in some embodiments, provide enhanced operating lifetimes under abrasive slurry conditions. For example, a composite suction liner includes a suction liner substrate and a monolithic cladding metallurgically bonded to a face of the suction liner substrate, the monolithic cladding comprising metal matrix composite including a hard particle phase dispersed in matrix metal or alloy. As described further herein, the hard particle phase can comprise a variety of hard particles including metal carbides, transition metal particles, alloy particles and mixtures thereof.

Further, a centrifugal pump described herein comprises an impeller including vanes extending between a base shroud and an upstream shroud and a composite suction liner comprising a suction liner substrate and a monolithic cladding metallurgically bonded to a face of the suction liner substrate, the monolithic cladding including metal matrix composite comprising a hard particle phase dispersed in matrix metal or alloy.

These and other embodiments are described in greater detail in the detailed description which follows.

BRIEF DESCRIPTION OF THE DRAWINGS

FIG. 2(*b*) is an optical image of an interface between metal matrix composite and hard particle tile of the monolithic cladding according to some embodiments described herein.

FIG. 3(*b*) illustrates the braze joint along the outer diameter of the composite cladding and suction liner substrate.

DETAILED DESCRIPTION

Figure 1C:
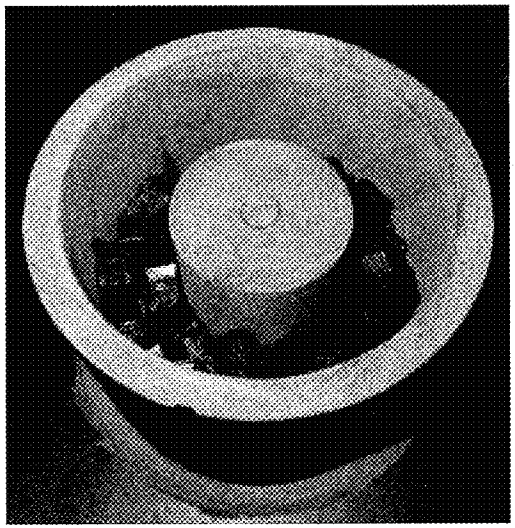
FIGS. 1(*a*)-(*c*) illustrate filling of a mold with hard particles and hard particle tiles for production of a composite cladding according to some embodiments described herein.

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

In one aspect, composite suction liners are described herein. A composite suction liner includes a suction liner substrate and a monolithic cladding metallurgically bonded to a face of the suction liner substrate, the monolithic cladding comprising metal matrix composite including a hard particle phase dispersed in matrix metal or alloy. Turning now to specific components, the suction liner substrate can be formed of any metal or alloy. In some embodiments, the suction liner substrate comprises ferrous alloys or non-ferrous alloys. For example, the suction liner substrate can comprise various steels such low-carbon steels, alloy steels, tool steels or stainless steels. In some embodiments, the suction liner substrate comprises AISI 4140 steel and/or AISI 316 stainless steel. The suction liner substrate can be of any dimension required by the centrifugal pump architecture. For example, in some embodiments, the suction liner substrate is cylindrical having an inner diameter ranging from 0.1 to 2 meters and an outer diameter ranging from 1 to 3 meters.

As described herein, a monolithic cladding is metallurgically bonded to a face of the suction liner substrate, the monolithic cladding comprising metal matrix composite including a hard particle phase dispersed in matrix metal or alloy. The hard particle phase can comprise a variety of hard particles including metal carbides, transition metal particles, alloy particles and mixtures thereof. In some embodiments, the hard particle phase comprises a tungsten carbide component selected from the group consisting of cast tungsten carbide particles, macrocrystalline tungsten carbide particles, carburized tungsten carbide particles, cemented tungsten carbide particles and mixtures thereof. For example, the hard particle phase can be a mixture comprising (a) about 30 to about 90 weight percent of a first component powder consisting of particles of cast tungsten carbide of −30 (600 micron)+140 (106 micron) in particle size; (b) about 10 to about 70 weight percent of a second component powder consisting of particles of at least one selected from the group consisting of macrocrystalline tungsten carbide, carburized tungsten carbide, and cemented tungsten carbide; and (c) up to about 12 weight percent of a third component powder consisting of particles of at least one selected from the group consisting of transition metals, main group metals, and alloys and combinations thereof. In some embodiments, the matrix powder mixture contains substantially no particles of the first component powder of −140 mesh (106 micron) in particle size and particles of the first component powder having a particle size of +100 mesh (150 microns) account for at least 15 weight percent of the matrix powder mixture.

Moreover, the hard particle phase can include metal carbides, metal nitrides, metal carbonitrides, metal borides, metal silicides, cemented carbides, cast carbides, intermetallic compounds or other ceramics or mixtures thereof. In some embodiments, metallic elements of hard particles comprise aluminum, boron, silicon and/or one or more metallic elements selected from Groups IVB, VB, and VIB of the Periodic Table. Groups of the Periodic Table described herein are identified according to the CAS designation. For example, hard particles can comprise carbides of tungsten, titanium, chromium, molybdenum, zirconium, hafnium, tantalum, niobium, rhenium, vanadium, boron or silicon or mixtures thereof. Hard particles, in some embodiments, comprise nitrides of aluminum, boron, silicon, titanium, zirconium, hafnium, tantalum or niobium, including cubic boron nitride, or mixtures thereof. Additionally, in some embodiments, hard particles comprise borides such as titanium di-boride, $B_4C$ or tantalum borides or silicides such as $MoSi_2$ or $Al_2O_3$—SiN. Hard particles can comprise crushed cemented carbide, crushed carbide, crushed nitride, crushed boride, crushed silicide, or other ceramic particle reinforced metal matrix composites or combinations thereof. Crushed cemented carbide particles, for example, can have 2 to 25 weight percent metallic binder. Additionally, hard particles can comprise intermetallic compounds such as nickel aluminide.

Hard particles can have any desired shape or geometry. In some embodiments, hard particles have spherical, elliptical or polygonal geometry. Hard particles, in some embodiments, have irregular shapes, including shapes with sharp edges. Generally, the hard particle phase can be present in an amount of 0.5 weight percent to 90 weight percent on the monolithic cladding. Hard particle content of the monolithic cladding can be selected according to several considerations including desired wear resistance and fracture toughness of the cladding. The hard particle phase is dispersed in matrix metal or matrix alloy of the cladding. Matrix metal or alloy of the cladding can be selected according to several considerations including, but not limited to, the compositional identity of the hard particle phase, the compositional identity of the metallic substrate and/or the service environment. For example, matrix metal or alloy has melting point or solidus temperature lower than the hard particles.

In some embodiments, matrix metal or alloy of the composite cladding is a brazing metal or brazing alloy. Any braze not inconsistent with the objectives of the present invention can be used as the matrix metal or alloy for infiltrating the hard particle phase. For example, matrix alloy can comprise copper-based alloy. Suitable copper-based alloys can comprise additive elements of 0-50 wt. % nickel, 0-30 wt. % manganese, 0-45 wt. % zinc, 0-10 wt. % aluminum, 0-5 wt. % silicon, 0-5 wt. % iron as well as other elements including phosphorous, chromium, beryllium, titanium, boron, tin, lead, indium, antimony and/or bismuth. In some embodiments, matrix alloy of the composite cladding is selected from the Cu-based alloys of Table I.

TABLE I

Cu-based Matrix Alloy

| Cu-Based Alloy | Compositional Parameters (wt. %) |
|---|---|
| 1 | Cu—(18-27)% Ni—(18-27)% Mn |
| 2 | Cu—(8-12)% Ni |
| 3 | Cu—(29-32)% Ni—(1.7-2.3)% Fe—(1.5-2.5)% Mn |
| 4 | Cu—(2.8-4.0)% Si—1.5% Mn—1.0% Zn—1.0% Sn—Fe—Pb |
| 5 | Cu—(7.0-8.5)Al—(11-14)% Mn—2-4)% Fe—(1.5-3.0)% Ni |
| 6 | Cu—(14-18)% Mn—(6-10)% Ni—(24-28)% Zn |
| 7 | Cu—(41-45)% Zn |
| 8 | Cu—(8-12)% Ni—(39-43)% Zn |
| 9 | Cu—(13-17)% Ni—(18-22)% Zn |
| 10 | Cu—(13-17)% Ni—(6-10)% Zn—(22-26)% Mn |

Matrix alloy of the cladding, in some embodiments, is cobalt-based alloy. Suitable cobalt-based alloy, in some embodiments, has compositional parameters derived from Table II.

TABLE II

Cobalt-based alloys

| Element | Amount (wt. %) |
|---|---|
| Chromium | 5-35 |
| Tungsten | 0-35 |
| Molybdenum | 0-35 |
| Nickel | 0-20 |
| Iron | 0-25 |
| Manganese | 0-2 |
| Silicon | 0-5 |
| Vanadium | 0-5 |
| Carbon | 0-4 |
| Boron | 0-5 |
| Cobalt | Balance |

In some embodiments, cobalt-based alloy of the cladding is selected from Table III.

TABLE III

Co-based Matrix Alloy

| Co-Based Alloy | Compositional Parameters (wt. %) |
|---|---|
| 1 | Co—(15-35)% Cr—(0-35)% W—(0-20)% Mo—(0-20)% Ni—(0-25)% Fe—(0-2)% Mn—(0-5)% Si—(0-5)% V—(0-4)% C—(0-5)% B |
| 2 | Co—(20-35)% Cr—(0-10)% W—(0-10)% Mo—(0-2)% Ni—(0-2)% Fe—(0-2)% Mn—(0-5)% Si—(0-2)% V—(0-0.4)% C—(0-5)% B |
| 3 | Co—(5-20)% Cr—(0-2)% W—(10-35)% Mo—(0-20)% Ni—(0-5)% Fe—(0-2)% Mn—(0-5)% Si—(0-5)% V—(0-0.3)% C—(0-5)% B |
| 4 | Co—(15-35)% Cr—(0-35)% W—(0-20)% Mo—(0-20)% Ni—(0-25)% Fe—(0-1.5)% Mn—(0-2)% Si—(0-5)% V—(0-3.5)% C—(0-1)% B |
| 5 | Co—(20-35)% Cr—(0-10)% W—(0-10)% Mo—(0-1.5)% Ni—(0-1.5)% Fe—(0-1.5)% Mn—(0-1.5)% Si—(0-1)% V—(0-0.35)% C—(0-0.5)% B |

TABLE III-continued

| Co-based Matrix Alloy | |
|---|---|
| Co-Based Alloy | Compositional Parameters (wt. %) |
| 6 | Co—(5-20)% Cr—(0-1)% W—(10-35)% Mo—(0-20)% Ni—(0-5)% Fe—(0-1)% Mn—(0.5-5)% Si—(0-1)% V—(0-0.2)% C—(0-1)% B |

Matrix alloy of the cladding can also be nickel-based alloy. Suitable nickel-based alloy can have compositional parameters derived from Table IV.

TABLE IV

| Ni-based Matrix Alloy | |
|---|---|
| Element | Amount (wt. %) |
| Chromium | 0-30 |
| Molybdenum | 0-5 |
| Niobium | 0-5 |
| Tantalum | 0-5 |
| Tungsten | 0-20 |
| Iron | 0-6 |
| Carbon | 0-5 |
| Silicon | 0-15 |
| Phosphorus | 0-10 |
| Aluminum | 0-1 |
| Copper | 0-50 |
| Boron | 0-1 |
| Nickel | Balance |

In some embodiments, matrix alloy of the cladding is selected from the Ni-based alloys of Table V.

TABLE V

| Ni-based Matrix Alloys | |
|---|---|
| Ni-Based Alloy | Compositional Parameters (wt. %) |
| 1 | Ni—(13.5-16)% Cr—(2-5)% B—(0-0.1)% C |
| 2 | Ni—(13-15)% Cr—(3-6)% Si—(3-6)% Fe—(2-4)% B—C |
| 3 | Ni—(3-6)% Si—(2-5)% B—C |
| 4 | Ni—(13-15)% Cr—(9-11)% P—C |
| 5 | Ni—(23-27)% Cr—(9-11)% P |
| 6 | Ni—(17-21)% Cr—(9-11)% Si—C |
| 7 | Ni—(20-24)% Cr—(5-7.5)% Si—(3-6)% P |
| 8 | Ni—(13-17)% Cr—(6-10)% Si |
| 9 | Ni—(15-19)% Cr—(7-11)% Si—)0.05-0.2)% B |
| 10 | Ni—(5-9)% Cr—(4-6)% P—(46-54)% Cu |
| 11 | Ni—(4-6)% Cr—(62-68)% Cu—(2.5-4.5)% P |
| 12 | Ni—(13-15)% Cr—(2.75-3.5)% B—(4.5-5.0)% Si—(4.5-5.0)% Fe—(0.6-0.9)% C |
| 13 | Ni—(18.6-19.5)% Cr—(9.7-10.5)% Si |
| 14 | Ni—(8-10)% Cr—(1.5-2.5)% B—(3-4)% Si—(2-3)% Fe |
| 15 | Ni—(5.5-8.5)% Cr—(2.5-3.5)% B—(4-5)% Si—(2.5-4)% Fe |

In further embodiments, the matrix alloy of the cladding is iron-based alloy. Several examples of iron-based matrix alloy are provided in Table VI.

TABLE VI

| Fe-Based Matrix Alloy | |
|---|---|
| Fe-Based Alloy | Compositional Parameters (wt. %) |
| 1 | Fe—(2-6)% C |
| 2 | Fe—(2-6)% C—(0-5)% Cr—(28-37)% Mn |

TABLE VI-continued

| Fe-Based Matrix Alloy | |
|---|---|
| Fe-Based Alloy | Compositional Parameters (wt. %) |
| 3 | Fe—(2-6)% C—(0.1-5)% Cr |
| 4 | Fe—(2-6)% C—(0-37)% Mn—(8-16)% Mo |

The composite cladding metallurgically bonded to a face of the suction liner substrate can further comprise hard particle tiles or compacts dispersed in the matrix alloy. In some embodiments, hard particle tiles are formed of sintered cemented carbide. The sintered cemented carbide can employ a Group VIIIB metal or alloy binder in an amount of 0.2 to 15 weight percent. For example, cobalt binder or cobalt alloyed with nickel and/or iron, in some embodiments, can be present in an amount of 0.5 to 10 weight percent of the sintered cemented carbide. Hard particle tiles can also be formed of carbides of titanium, chromium, molybdenum, zirconium, hafnium, tantalum, niobium, rhenium, vanadium, boron or silicon or mixtures thereof. Hard particle tiles, in some embodiments, comprise nitrides of aluminum, boron, silicon, titanium, zirconium, hafnium, tantalum or niobium, including cubic boron nitride, or mixtures thereof. Additionally, hard particle tiles can comprise borides such as titanium di-boride, $B_4C$ or tantalum borides or silicides such as $MoSi_2$ or $Al_2O_3$—SiN. In further embodiments, hard particle tiles can include crushed cemented carbide, crushed carbide, crushed nitride, crushed boride, crushed silicide, ceramic particle reinforced metal matrix, silicon carbide metal matrix composites or combinations thereof.

The hard particle tiles, in some embodiments, include coatings formed of metals, alloys or ceramics. For example, the hard particle tiles can have a coating comprising one or more of nickel, cobalt, iron and molybdenum. Moreover, the hard particle tiles can be fully dense or substantially fully dense. For example, the hard particle tiles can have porosity less than 10 volume percent or less than 5 volume percent. Alternatively, the hard particle tiles can exhibit porosity. In some embodiments, the porosity can be interconnected porosity. Interconnected porosity can comprise interconnected pore structures permitting matrix metal or alloy to penetrate and flow throughout the body of a hard particle tile, thereby providing a greater degree of bonding between the matrix metal or alloy and the hard particle tile.

Hard particle tiles of claddings described herein can be provided in any desired shape. Hard particle tiles can be polygonal, circular or elliptical. For example, in some embodiments, a hard particle tile is square, rectangular, hexagonal or round. The hard particle tiles can exhibit a predetermined arrangement or pattern in the matrix metal or alloy. For example, the hard particle tiles can have a periodic radial arrangement in the matrix alloy. In another embodiment, the hard particle tiles can have a random arrangement in the matrix alloy. In particular embodiments, the composite cladding can have composition and properties described in U.S. Pat. No. 6,984,454 and/or U.S. Pat. No. 8,016,057 each of which is incorporated herein by reference in its entirety.

As described herein, the composite cladding bonded to the suction liner substrate can be monolithic or single-piece. In being monolithic, the cladding is continuous over the face of the suction liner substrate. Such continuous structure can be free of seams and/or joints that can compromise cladding integrity by serving as sites of uneven or enhanced wear. For example, surface(s) of the monolithic cladding can be free of seams or joints. In addition to being continuous, the cladding can exhibit a uniform or substantially uniform microstructure. The hard particle phase, for example, can be uniformly or substantially uniformly dispersed in the matrix metal or matrix alloy. Alternatively, the cladding microstructure can be heterogeneous. For example, in some embodiments, the cladding has a gradient of the hard particle phase. In such embodiments, the cladding can have one or more regions of high hard particle concentration and one or more regions of lower hard particle concentration. The high hard particle concentration regions can be positioned in the cladding to correspond to high wear regions of the suction liner.

Moreover, the composite cladding can be fully dense or substantially fully dense. For example, the cladding can have porosity less than 5 volume percent or less than 3 volume percent. The composite cladding can have any desired thickness. The cladding, in some embodiments, has thickness greater than 0.5 cm. In some embodiments, cladding thickness is selected from Table VII.

TABLE VII

| Monolithic Cladding Thickness (cm) |
|---|
| 0.5-15 |
| 0.75-15 |
| 1-15 |
| 0.5-10 |
| 0.75-10 |
| 1-10 |

Cladding thickness can be uniform or can vary along the surface of the suction liner substrate. For example, cladding thickness can be proportional to wear rate along the suction liner.

Generally, the metal matrix composite cladding can be formed by infiltration processes. In some embodiments, the metal matrix composite cladding is formed directly on surfaces of the suction liner substrate, including the suction liner face(s), inner diameter and/or outer diameter. For example, a cylindrical mold having an inner diameter sleeve is placed over a face of the suction liner and filled with hard particles of the hard particle phase. Hard particle tiles may also be placed or arranged in the mold. A source of matrix metal or matrix alloy is positioned over the hard particle phase in the mold and heated. The matrix metal or alloy can be in powder form, sheet form and/or provided as chunks. Molten matrix alloy infiltrates the hard particle phase forming the metal matrix composite cladding and metallurgically bonding the cladding to the face of the suction liner. Process efficiencies are realized as the composite cladding can be formed and metallurgically bonded to surfaces of the suction liner substrate in a single processing step.

Figure 1B:
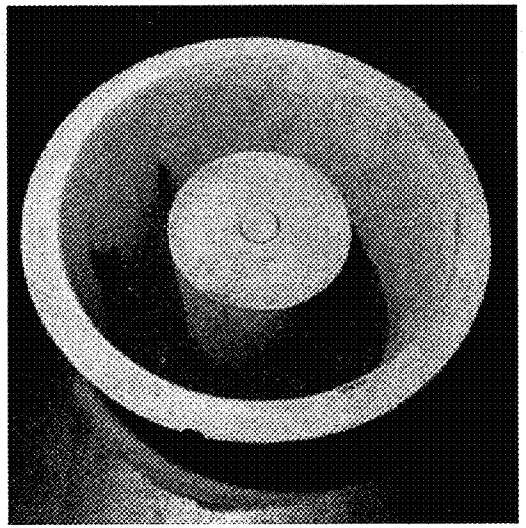
Figure 1A:
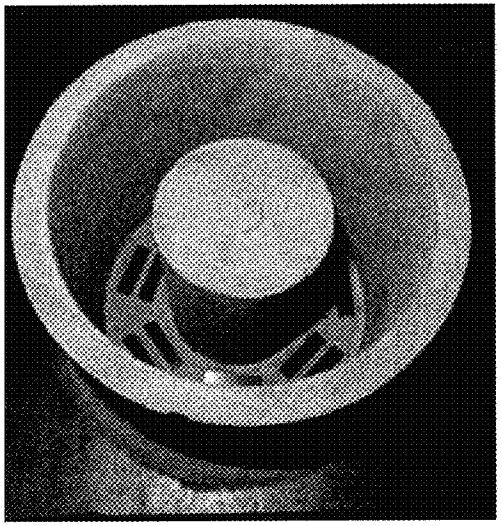

FIGS. 1(*a*)-(*c*) illustrate a mold filling process according to one embodiment described herein. As illustrated in FIG. 1(*a*), the cylindrical mold comprises a central sleeve for forming the inner diameter of the metal matrix composite cladding. Sintered cemented carbide rectangular tiles are radially arranged in the mold. Metal carbide powder is added to the mold as in FIG. 1(*b*). In some embodiments, the mold can be vibrated to enhance packing characteristics of the hard particle powder. Copper-based matrix alloy is subsequently added to the mold. In the embodiment of FIG. 1(*c*), chunks of copper-based matrix alloy are added to the mold. The mold is closed and heated to infiltrate the hard particle phase with molten matrix alloy, producing the monolithic cladding metallurgically bonded to the suction liner substrate. As described herein, the mold can be configured such that composite cladding is formed over and metallurgically bonded to one or more surfaces of the suction liner substrate. For example, the composite cladding can be formed over and metallurgically bonded to a face of the suction liner substrate. The composite cladding can also be formed over and metallurgically bonded to inner diameter and/or outer diameter surfaces in addition to one or more faces of the suction liner substrate. When covering multiple surfaces, the composite cladding can maintain a monolithic or single-piece construction, extending continuously from surface to surface without joints and/or seams. For example, the composite cladding can reside over the inner diameter surface and extend continuously over face(s) of the suction liner substrate. In some embodiments, the composite cladding can further extend in a continuous manner to cover the suction liner outer diameter.

Figure 2B:
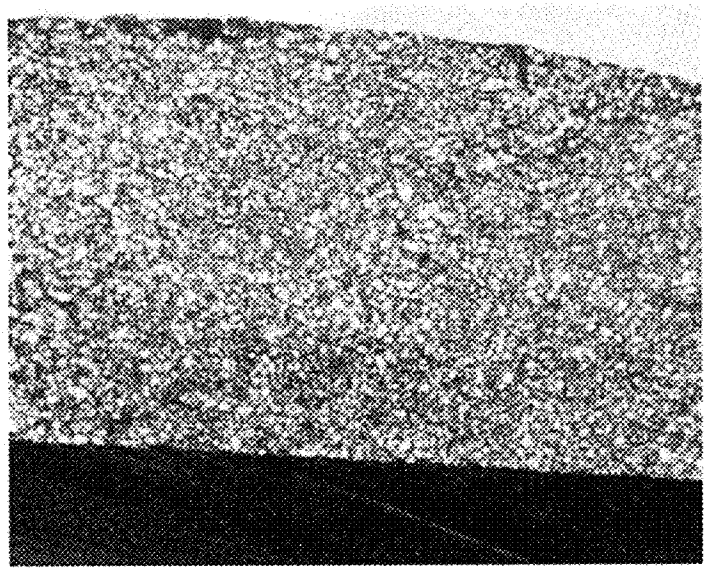
FIG. 2(*a*) illustrates a section of a monolithic cladding face after grinding.
Figure 2A:
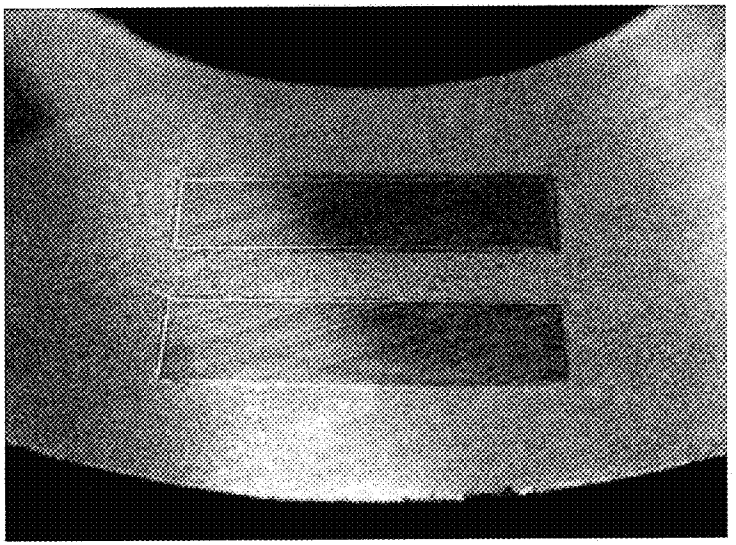

FIG. 2(*a*) illustrates a section of the monolithic cladding face after grinding. As illustrated in FIG. 2(*a*), the hard particle tiles are embedded in metal matrix composite. FIG. 2(*b*) is a higher magnification optical image of the interface between the metal matrix composite and hard particle tile. In being imbedded in the metal matrix composite, the hard particle tiles form a continuous structure and do not present any joints or seams, such as those employed with segmented parts. The metal matrix composite exhibits a substantially uniform structure of metal carbide particles dispersed in the copper-based matrix alloy.

Figure 3B:
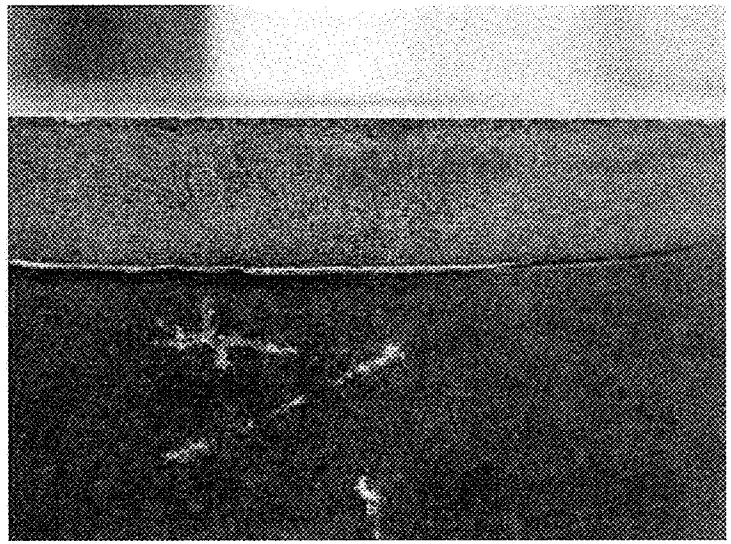
FIG. 3(*a*) illustrates a braze joint along the inner diameter of the composite cladding and suction liner substrate according to one embodiment described herein.
Figure 3A:
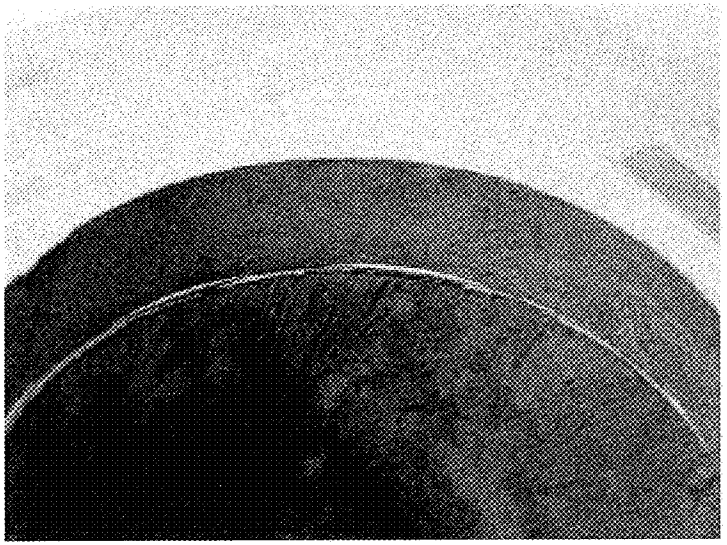

Alternatively, the monolithic cladding can be formed independently of the suction liner substrate. In such embodiments, the monolithic cladding is self-supporting and arranged over the suction liner substrate. Once fabricated the metal matrix composite cladding can be metallurgically bonded to a face of the suction liner by brazing. Any suitable brazing metal or alloy can be employed to form the braze joint between the cladding and suction liner surface. FIG. 3(*a*) illustrates a braze joint along the inner diameter of the metal matrix composite cladding and suction liner substrate according to one embodiment described herein. FIG. 3(*b*) illustrates the braze joint along the outer diameter of the cladding and suction liner substrate.

Figure 4:
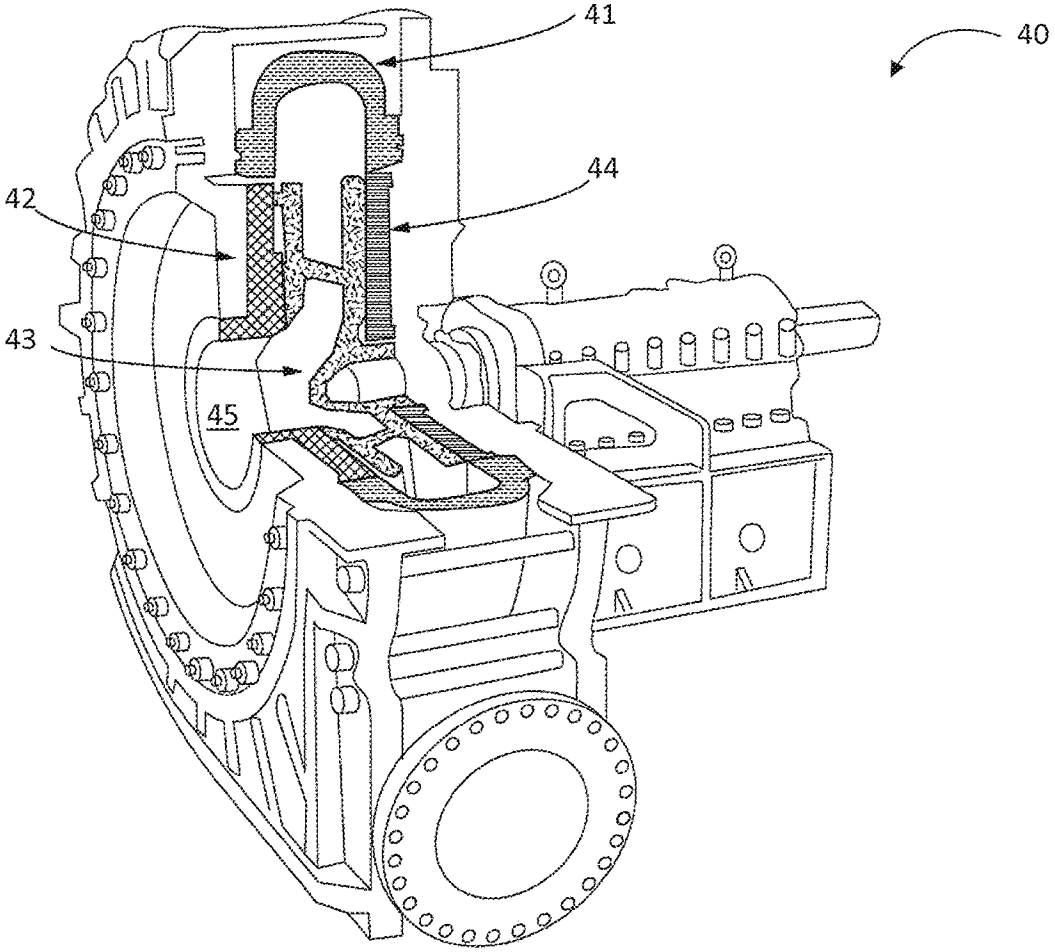
FIG. 4 is a cut-away view of a centrifugal pump according to one embodiment described herein.

Centrifugal pumps employing composite suction liners are also described herein. A centrifugal pump comprises an impeller including vanes extending between a base shroud and an upstream shroud and a composite suction liner comprising a suction liner substrate and a monolithic cladding metallurgically bonded to a face of the suction liner substrate, the monolithic cladding including metal matrix composite comprising a hard particle phase dispersed in matrix metal or alloy. The composite suction liner of the centrifugal pump can have any construction and properties described herein above. FIG. 4 illustrates a cut-away view of a centrifugal pump according to one embodiment described herein. The centrifugal pump (40) comprises casing (41) that houses the composite suction liner (42), impeller (43) and back liner (44). The composite cladding of the suction liner (42) faces the impeller (43) and extends radially from the pump inlet (45) toward the casing (41). Thickness of the composite cladding can also permit the cladding to form an end portion of the suction liner inlet where wear is generally high.

Centrifugal pumps having architectures described herein can be employed in a variety of applications. In some embodiments, the centrifugal pump is a slurry pump for operation in mining operations including, but not limited to, the processing of oil sands and other abrasive materials.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A composite suction liner of a centrifugal pump comprising:

a suction liner substrate; and a monolithic cladding metallurgically bonded to a face of the suction liner substrate, the monolithic cladding comprising metal matrix composite including a hard particle phase dispersed in matrix metal or alloy, the hard particle phase including a mixture comprising:

(a) about 30 to about 90 weight percent of a first component powder consisting of particles of cast tungsten carbide of −30 (600 micron)+140 (106 micron) in particle size;

(b) about 10 to about 70 weight percent of a second component powder consisting of particles of at least on selected from the group consisting of macrocrystalline tungsten carbide, carburized tungsten carbide, and cemented tungsten carbide; and (c) up to about 12 weight percent of a third component powder consisting of particles of at least one selected from the group consisting of transition metal, main group metals, and alloys and combinations thereof, wherein particles of the first component powder having a particle size of +100 mesh account for at least 15 weight percent of the powder mixture.

2. The composite suction liner of claim 1, wherein the matrix alloy is selected from the group consisting of copper-based alloy, nickel-based alloy, cobalt-based alloy and iron-based alloy.

3. The composite suction liner of claim 1, wherein the metal matrix composite further comprises hard particle tiles.

4. The composite suction liner of claim 3, wherein the hard particle tiles exhibit a periodic radial arrangement in the cladding.

5. The composite suction liner of claim 3, wherein the hard particle tiles are formed of sintered cemented carbide.

6. The composite suction liner of claim 5, wherein the sintered cemented carbide includes metallic binder in an amount of 0.5 to 10 weight percent.

7. The composite suction liner of claim 1, wherein the monolithic cladding has a thickness of greater than 0.5 cm.

8. The composite suction liner of claim 1, wherein the monolithic cladding has a thickness of 0.5 cm to 15 cm.

9. The composite suction liner of claim 1, wherein the monolithic cladding is free of joints.

10. The composite suction liner of claim 1, wherein the monolithic cladding is free of seams.

11. The composite suction liner of claim 1, wherein the monolithic cladding is metallurgically bonded to the suction liner substrate by a braze joint.

12. The composite suction liner of claim 1, wherein the monolithic cladding is further metallurgically bonded to an inner diameter surface of the suction liner substrate.

13. The composite suction liner of claim 1, wherein the monolithic cladding is further metallurgically bonded to an outer diameter surface of the suction liner substrate.

14. A centrifugal pump comprising:

an impeller including vanes extending between a base shroud and upstream shroud; and a composite suction liner comprising a suction liner substrate and a monolithic cladding metallurgically bonded to a face of the suction liner substrate, the monolithic cladding comprising metal matrix composite including a hard particle phase dispersed in matrix metal or alloy, the hard particle phase including a mixture comprising:

(a) about 30 to about 90 weight percent of a first component powder consisting of particles of cast tungsten carbide of −30 (600 micron)+140 (106 micron) in particle size;

(b) about 10 to about 70 weight percent of a second component powder consisting of particles of at least on selected from the group consisting of macrocrystalline tungsten carbide, carburized tungsten carbide, and cemented tungsten carbide; and (c) up to about 12 weight percent of a third component powder consisting of particles of at least one selected from the group consisting of transition metal, main group metals, and alloys and combinations thereof, wherein particles of the first component powder having a particle size of +100 mesh account for at least 15 weight percent of the powder mixture.

15. The centrifugal pump of claim 14, wherein the monolithic cladding is free of joints or seams.

16. The centrifugal pump of claim 15, wherein an end portion of a fluid stream inlet of the suction liner is formed of the monolithic cladding.

17. The centrifugal pump of claim 14, wherein the pump is a slurry pump.

* * * * *